United States Patent [19]

Lotfy

[11] 4,248,423

[45] Feb. 3, 1981

[54] TETHERBALL

[76] Inventor: Hussein M. Lotfy, 28, Sherif St., Cairo, Egypt

[21] Appl. No.: 56,934

[22] Filed: Jul. 12, 1979

[51] Int. Cl.[3] ..... A63B 39/00

[52] U.S. Cl. ..... 273/58 C; 273/413

[58] Field of Search ..... 273/58 C, 413, 414, 273/327, 331, 58 B, 58 D, 58 E, 58 BA, 58 R, 26 E, 29 A

[56] References Cited

U.S. PATENT DOCUMENTS

| | | | |
|---|---|---|---|
| 2,003,957 | 6/1935 | Salisbury | 273/58 E |
| 3,459,158 | 8/1969 | Mitchell | 273/58 C X |
| 3,729,195 | 4/1973 | Hutt et al. | 273/58 C |
| 3,764,140 | 10/1973 | Lotfy | 273/58 C X |
| 3,829,093 | 8/1974 | Abrams | 273/414 X |
| 4,113,257 | 9/1978 | Moffatt | 273/58 C X |

*Primary Examiner*—George J. Marlo

*Attorney, Agent, or Firm*—Leydig, Voit, Osann, Mayer & Holt, Ltd.

[57] ABSTRACT

An improved ball for use in playing tetherball games is characterized by its construction of unitary seamless resilient material, such as rubber, having an oval shape when at rest and having holes at opposite ends of the smaller axis of the ball. Through the smaller of these holes a cord is attached to the ball, preferably by means of a stop introduced into the interior of the ball by way of the larger hole. The stop has a passage extending axially through it through which a suspension cord or tether is passed. The larger hole is left open to the air, and thus imparts superior cooling properties to the ball which enhances its longevity. The exposure of this hole to the air also provides a whistling sound as the ball orbits thereby providing an added element of enjoyment to the game in which the ball is used. Further, by being attached to the suspension cord on the smaller axis of the ball, the ball in orbiting when struck tends to assume a spherical shape due to the centrifugal force exerted on it during play.

4 Claims, 3 Drawing Figures

TETHERBALL

BACKGROUND OF THE INVENTION

1. Field of the Invention

The present invention relates generally to recreational games and a ball that finds particular utility in the play of games of the tetherball type.

Recreational games of the tetherball type are numerous. In this type of game, a ball is typically attached to one end of a flexible cord, or tether, and of which the other end is attached to the upper end of an upright or vertically disposed pole or standard. The concept of such games, as for example, English tetherball and tether-tennis, is the winding, or wrapping, as a result of a player's striking the ball, of the cord around the pole, or in the case of the spool disclosed in U.S. Pat. No. 3,764,140, the free slippage of the cord about the pole. Play consists of hitting the ball so that it orbits, while suspended by the cord, in either direction about the standard according to any selected rules.

An example of one of these tetherball games and the apparatus used in its play is that disclosed in U.S. Pat. No. 3,764,140 wherein a spherical hollow ball, such as a tennis ball, is tethered by a flexible, non-resilient cord to a pole or standard disposed in a stationary vertical position, which ball is struck by a paddle wielded by a player so that it orbits about the standard.

Experience has shown that a hollow, spherical ball, such as a tennis ball, when used in tether games rapidly deteriorates and tears because of heat generated within the ball when it is struck and the traditional system used to fasten the ball to the cord. Typically, the fastening relies on making a hole in the ball and using a peg or piece of wood or the like inside the ball as a stop to which the cord is attached. Once the cord is attached to the ball in this manner, the wood stop inside the ball is brought up sharply against the interior of the ball, and with the heat generated within it as the ball is struck repeatedly during a game, the ball deteriorates quite rapidly.

Accordingly, it is an object of this invention to provide an improved ball of resilient material and of relatively inexpensive construction, and one that does not easily deteriorate in use thereby prolonging playing time before the ball must be replaced.

2. Summary of the Invention

The present invention is directed to the provision of an improved ball for use in playing tetherball games. The novel ball is characterized by its fabrication of a single piece of seamless resilient material, such as rubber, of an oval configuration when at rest, and having holes of unequal size at opposite ends of the smaller axis of the ball. By way of the smaller of these holes a cord, or tether, is attached to the ball, preferably by means of a stop. The stop is preferably formed of two identical pieces, which are disposed in aligned relation, and the stop is introduced into the interior of the ball by way of the larger hole. The stop has a passage extending axially through it. The tether or suspension cord is passed through the axial passages, and the end of the cord is knotted interiorly of the ball. Because the larger hole remains open, air compressed within the ball when it is struck can escape readily and the ball stays cooler during play thereby prolonging the life of the ball. This open hole also provides a whistling sound as the ball moves through the air thereby providing an added element of enjoyment to the game. Further, by having the ball attached at a small diameter to the tethering cord, the ball when struck will tend to assume a spherical shape due to the centrifugal force to which the ball is subjected as it orbits about the vertically disposed standard to which the cord is attached.

DETAILED DESCRIPTION OF THE INVENTION

Figure 1:
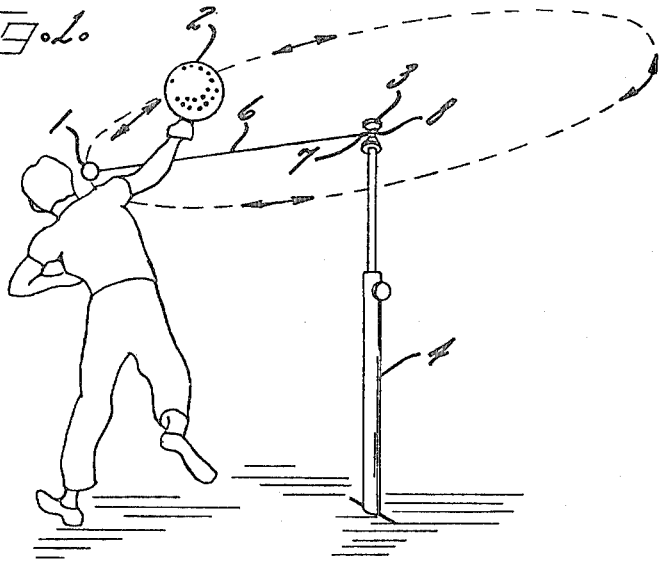
FIG. 1 depicts the manner in which one tetherball game is played by a player striking the ball with a paddle, racquet or the like and orbiting it about a standard disposed in a stationary vertical position.

The manner in which the exemplary games is played is illustrated in FIG. 1, where there is shown a player striking a ball 1, with a paddle 2 thereby causing the ball to orbit about a spool 3 which is attached to the top of an elongated standard 4. The standard is disposed in a stationary vertical position and has the ability to be adjusted in vertical height so that the ball hangs clear of the playing surface when the ball is at rest.

Figure 2:
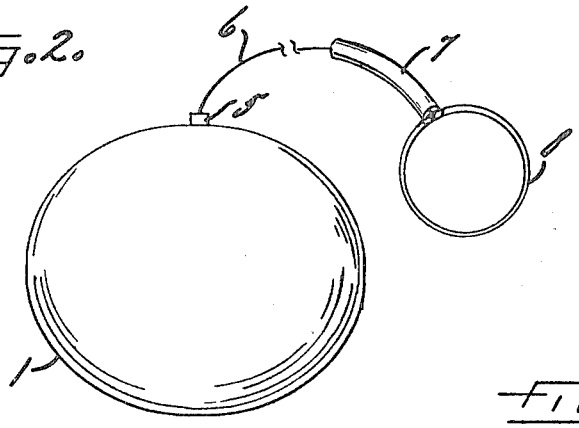
FIG. 2 is an elevational view of the oval shaped ball of the present invention and its tethering cord as shown in use in FIG. 1.

In accordance with the present invention, the ball 1 is of oval form and is formed of resilient material, such as rubber, free of seams, and is fashioned to be tethered along its shorter axis. Thus, as will be seen in FIG. 2, a nipple 5 projects outwardly of the ball 1 and receives a tethering cord 6. At one end the cord passes through a protective nylon tubing 7 and is attached to a ring 8, by which the cord is journaled upon the spool 3 (of FIG. 1) atop the standard 4.

Figure 3:
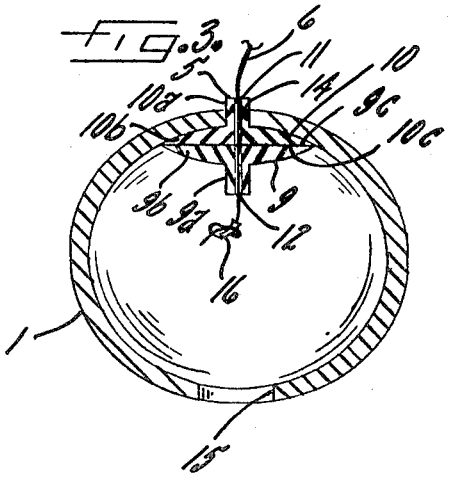
FIG. 3 is a vertical cross section through the ball of the preceding figures and shows the interior of the ball and the manner in which it is tethered in accordance with the invention.

As shown in FIG. 3 the nipple 5 is integral with one of two identical pieces 9 and 10 which together from a stop interiorly of the ball 1. The cord 6 is secured to the ball by running it through holes 11 and 12 which extend axially of stop pieces 9 and 10 to define a passage running entirely through the stop 9, 10.

As can best be seen in FIG. 3, the ball 1 is provided with holes 14 and 15 which are disposed in aligned relation on the shorter axis of the ball. The smaller hole 14 receives the nipple 5 of the stop piece 9 with the nipple extending through the hole 14. Assembly is effected with the stop pieces 9 and 10 outside the ball and disposed in juxtaposed relation with the holes 11 and 12 therethrough aligned. The cord 6 is first passed through the ball's holes 14 and 15 and then through the passage defined by the aligned holes 11 and 12 of the stop 9,10. A knot 16 is then tied in the end of the cord 6 so that the cord cannot be pulled back through stop 9,10. The stop pieces 9 and 10 are then inserted into the interior of ball through the larger hole 15, and the nipple 5 of stop piece 9 is snuggly received in place within axial hole 14 as shown in FIG. 3. Thus the ball 1 is fastened to the tethering cord 6 with the stop 9,10 resting intimately against the inner surface of the ball.

The large hole 15, at the outer end of the shorter axis of the ball, remains open and serves the added functions of (1)providing a whistling sound during play of a game adding a pleasurable element of sound to the game, and of (2) dissipating heat generated interiorly of the ball when it is struck as by a player wielding the paddle 2 thereby prolonging the life of the ball.

Preferably the stop 9, 10 is formed of two identical pieces of resilient material such as rubber with the passage defined by holes 11 and 12 extending through its entire length when the pieces are properly aligned. The passage 11, 12 through the stop 9, 10 has a diameter of about 1½ mms. and, of course, the cord must be capable of being passed through it. Each piece of the preferred stop 9, 10 consists of a cylindrical part 9*a* and 10*a*, the length of which is about 1½ times the thickness of the ball wall so that the nipple portion 5 of the cylindrical portion of the stop piece 9 extends out through the hole 14 beyond the wall of the ball.

Each of the two preferred stop pieces 9 and 10 is enlarged at one end to form discs 9*b* and 10*b* having arcuate, outer surfaces which are conformable to the inner surface of the wall of the ball 1. The other, or juxtaposed, surfaces 9*c* and 10*c* of the discs are planar. Preferably, the diameter of the discs 9*b* and 10*b* of stop 9, 10 is about four times the external diameter of the cylindrical parts 9*a* and 10*a*, and both the stop pieces 9 and 10 are disposed in such a way that the two planar surfaces abut each other inside the ball, and the arcuate surface of the uppermost stop piece contacts the inner wall of the ball over its entire surface thereby effectively distributing the force of the pulling action of the tethering cord 6 over a large area of the inner surface of the ball's wall.

Although not illustrated in the accompanying drawing, it is contemplated that a piece of plastic material may be used to effectively enlarge the knot 16 to secure the ball to the cord thereby rendering impossible the extraction of the cord from the ball. It is also within the ambit of the present invention that stops of alternative form be used in the place of the exemplary stop 9, 10 shown.

The present invention is susceptible of various modifications and alternative forms. It should, therefore, be understood that it is not intended to limit the invention to the particular form disclosed, but, on the contrary, the intention is to cover all modifications, equivalents and alternatives falling within the spirit and scope of the invention as expressed in the appended claims.

I claim:

1. A ball for use in playing tetherball games comprising a hollow unitary piece of resilient material, said ball being oval in shape when at rest and having two holes at opposite ends of the shorter axis of said ball, one of said holes being larger than the other for introduction of a stop into the interior of said ball for use in attaching a tethering cord to said ball at the smaller hole, said ball characterized by increased life due to dissipation of the heat generated when the ball is struck and further characterized when in use by a whistling sound resulting from said larger hole being exposed to the air.

2. In recreational apparatus comprising an elongated standard for disposition in a stationary upright position, a tethering cord having a first and a second end and coupled at said first end to said elongated standard and at said second end to a ball, and wherein said appartus is adapted for said ball to be propelled with a hand-held paddle, the improvement comprising a ball comprised of a hollow unitary piece of seamless resilient material oval in shape when at rest and having two holes of unequal size at opposite ends of the shorter axis of said ball, said ball being secured at the smaller of said holes to said second end of said cord by a stop.

3. The apparatus of claim 2 wherein said stop is comprised of a first and a second piece identical in construction and each having a cylindrical portion on one end of which is a disc portion, said disc portion of said first piece having an arcuate surface closest to said cylindrical portion corresponding in curvature to the inner surface of the ball and a planar surface remote from said cylindrical portion, and wherein said cord extends through an axial hole in each of said first piece and said second piece, which holes are aligned and their planar surfaces in abutting juxtaposition, and said second end of said cord has a knot therein and the cylindrical portion of said first piece is positioned in the smaller of said holes in the ball, whereby said cord is securely fastened to said ball.

4. The apparatus of claim 3 wherein the hole in said identical pieces of said stop is about 1½ mm. in diameter and wherein said cylindrical portions of said two identical pieces have a length of about 1½ times the thickness of the ball wall and an external diameter about equal to the thickness of the ball wall.

* * * * *